US008079837B2

(12) United States Patent
Ochiai

(10) Patent No.: US 8,079,837 B2
(45) Date of Patent: Dec. 20, 2011

(54) COMPRESSOR

(75) Inventor: Yoshihiro Ochiai, Tomioka (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 434 days.

(21) Appl. No.: 12/517,532

(22) PCT Filed: Dec. 5, 2007

(86) PCT No.: PCT/JP2007/073464

§ 371 (c)(1),
(2), (4) Date: Jun. 3, 2009

(87) PCT Pub. No.: WO2008/072513

PCT Pub. Date: Jun. 19, 2008

(65) Prior Publication Data

US 2010/0021327 A1 Jan. 28, 2010

(30) Foreign Application Priority Data

Dec. 7, 2006 (JP) ..... 2006-330530

(51) Int. Cl.
*H01J 17/22* (2006.01)

(52) U.S. Cl. ..... 417/559

(58) Field of Classification Search ..... 313/297, 313/427, 447, 458, 479, 480, 482–483, 486, 313/496, 523, 531, 536, 538, 545
See application file for complete search history.

(56) References Cited

FOREIGN PATENT DOCUMENTS

JP 2004100563 * 4/2009

* cited by examiner

*Primary Examiner* — Bumsuk Won
*Assistant Examiner* — Brenitra Lee
(74) *Attorney, Agent, or Firm* — Baker Botts L.L.P.

(57) ABSTRACT

Compressor (1) having a region of pressure intermediate between discharge pressure and suction pressure (especially, crank chamber (10)), characterized in that a valve mechanism (21) is provided for introducing discharge gas into the region of intermediate pressure so as to render constant the difference between intermediate pressure and suction pressure. A compressor structure is provided which can stably introduce a mixture of discharge gas and refrigerating machine oil into the crank chamber without using pressure reducing means such as an aperture and in a manner easy to form a passageway, thereby improving the lubricity of rolling part and slide part in the crank chamber.

13 Claims, 2 Drawing Sheets

COMPRESSOR

Cross-Reference To Related Applications

This application is the National Stage of International Patent Application No. PCT/JP2007/073464, filed Dec. 5, 2007, which claims the benefit of Japanese Patent Application No. 2006-330530, filed Dec. 7, 2006, the disclosures of which are incorporated herein by reference in their entirety.

TECHNICAL FIELD OF THE INVENTION

The present invention relates to a compressor having a region of pressure intermediate between discharge pressure and suction pressure, especially, a region of crank chamber pressure, and in more detail, to a compressor enabling easy performance of adequate lubrication, in particular, suitable for a case where refrigerant whose pressure difference between high pressure side and low pressure side is great, such as carbon dioxide refrigerant, is used.

BACKGROUND ART OF THE INVENTION

In an air conditioning system using a fluorine compound such as HFC134, which has been broadly employed, as refrigerant, lubricating oil such as refrigerating machine oil is mixed into refrigerant beforehand, the lubricating oil is separated from the refrigerant when compressed refrigerant temporarily stays in a discharge chamber of a compressor, and the separated lubricating oil is supplied to a crank chamber by urging the oil by a pressure difference between discharge pressure and suction pressure or intermediate pressure therebetween, thereby lubricating rolling part or slide part in a crank case.

In such a structure for supplying lubricating oil, the pressure difference between discharge pressure and suction pressure utilized for urging the lubricating oil becomes great, there is a case where the amount of supplied lubricating oil becomes too great, and therefore, for example, as described in Patent document 1, the flow rate of lubricating oil is suppressed by increasing the resistance of a flow path by inserting a pressure reducing member such as an aperture with a small diameter or a porous material into an oil supply passageway for the lubricating oil or by forming the oil supply passageway as a thin and long passageway.

In an air conditioning system using carbon dioxide as refrigerant, however, because the pressure difference between suction pressure and discharge pressure increases about five times as compared with a case of an air conditioning system using a usual refrigerant such as HFC134, in order to perform a forcible lubrication by urging lubricating oil by a pressure difference between discharge pressure and suction pressure in the refrigerant compressor using carbon dioxide refrigerant, it is necessary to supply the lubricating oil after suppressing the flow rate of the lubricating oil further greatly as compared with the case of usual refrigerant, and therefore, it is inevitable to form the aperture and the like, to be provided in the oil supply passageway as a pressure reducing member, as one which is very thin and long. However, if done so, clogging ascribed to foreign matters liable to occur.

Accordingly, as another measure, a structure is disclosed in Patent document 2 wherein an intermittent oil supply mechanism is formed on an oil supply passageway without using a pressure reducing member, thereby shortening a substantial oil supply time to control the amount of supplied oil. Although this structure is effective for preventing clogging ascribed to foreign matters, there is a problem that machining of a communication hole from an oil storage chamber and machining of a hole of a piston are troublesome.

Patent document 1: Japanese Utility Model Laid-Open 59-119992

Patent document 2: JP-A-11-241682

DISCLOSURE OF THE INVENTION

Problems to be Solved by the Invention

An object of the present invention is to provide a structure of a compressor which can stably introduce a mixture of discharge gas and refrigerating machine oil into a crank chamber without using pressure reducing means such as an aperture and in a manner easy to form a passageway, thereby improving the lubricity of rolling part and slide part in the crank chamber, and further, which can hold refrigerating machine oil in the crank chamber, thereby improving an efficiency of a heat exchanger, etc. and reducing a pressure loss of a refrigeration cycle by reducing an oil circulation rate in the refrigeration cycle.

Means for Solving the Problems

To achieve the above-described object, a compressor according to the present invention has a region of pressure intermediate between discharge pressure and suction pressure, and is characterized in that a valve mechanism is provided for introducing discharge gas into the region of intermediate pressure so as to render constant a pressure difference between intermediate pressure and suction pressure. Namely, it is a structure wherein, without using pressure reducing means such as an aperture easily clogged by foreign matters, by the valve mechanism, discharge gas is appropriately introduced into the region of intermediate pressure requiring lubrication so as to keep the pressure difference between intermediate pressure and suction pressure at a constant pressure difference set in advance.

For example, the above-described valve mechanism may be structured so that the valve mechanism comprises an intermediate pressure introducing path communicating with the region of intermediate pressure, a suction pressure introducing path communicating with a region of suction pressure, a discharge gas introducing path capable of introducing discharge gas, a valve body having an intermediate pressure sensitive surface sensing intermediate pressure introduced from the intermediate pressure introducing path and a suction pressure sensitive surface sensing suction pressure introduced from the suction pressure introducing path on respective sides in a movement direction and having therein a communication path capable of communicating the intermediate pressure introducing path and the discharge gas introducing path with each other by movement, and a spring capable of giving a force corresponding to the constant pressure difference to the valve body. In this case, it is preferred that a first stopper is provided to an intermediate pressure introducing path side of the valve body for stopping the valve body having been moved at a position at which the intermediate pressure introducing path and the discharge gas introducing path communicate with each other through the communication path. Further, it is preferred that a second stopper is provided also to a suction pressure introducing path side of the valve body for stopping the valve body having been moved at a predetermined position. Where, it is preferred that a first pressure equalizing hole is provided to the first stopper, which is provided to the intermediate pressure introducing path side, for communicating both sides of the stopper at a state where the valve body has been stopped by the stopper at the position at which the intermediate pressure introducing path and the discharge gas introducing path communicate with each other and for introducing intermediate pressure onto the intermediate pressure sensitive surface. Further, it is preferred that a second pressure equalizing hole is provided also to the second stopper for communicating both sides of the stopper at a state where the valve body has been stopped by the stopper at the predetermined position and for introducing suction pressure onto the suction pressure sensitive surface.

More concretely, for example, it is structured as follows. Namely, a valve mechanism is provided to the compressor which introduces discharge gas (discharge gas pressure (Pd)) into a crank chamber so that a pressure difference (ΔP) between crank chamber pressure (Pc) as intermediate pressure and suction pressure (Ps) becomes a predetermined constant pressure difference. The valve body of the valve mechanism has surfaces sensing Pc and Ps in the movement direction of the valve body, and on the side of suction pressure (Ps), a spring generating a force corresponding to ΔP is provided at a position between the second stopper and the valve body. Further, on the side of crank chamber pressure (Pc), the first stopper is provided so that the valve body is stopped at a position where Pd introducing path from Pd region and the region of crank chamber pressure (Pc) communicate with each other through the communication path of the valve body, and on the side of suction pressure (Ps), the second stopper is provided so that the valve body is stopped at a predetermined position. To the first and second stoppers, first and second pressure equalizing holes capable of introducing the pressures of Pc, Ps are provided so that the surfaces of the valve body sensing the pressures of Pc, Ps can have target pressure receiving areas even if the valve body comes into contact with each stopper.

In such a structure, the following operation can be performed. For example, the degree of the pressure difference represented by Pc−Ps necessary to change an inclination angle of a swash plate in a swash plate type variable displacement compressor, is different depending upon discharge pressure, suction pressure and rotational speed, and it is designed so that the inclination angle of the swash plate does not change so long as the pressure difference does not exceed a certain value. As setting of the above-described pressure difference (ΔP) in the present invention, a range where change of the inclination angle of the swash plate does not occur is supposed, and as a condition of a displacement control valve, an opening degree of a completely closed condition or a condition where the inclination angle of the swash plate does not change is supposed. Usually, when the opening degree of the displacement control valve becomes a completely closed condition, the pressure difference of Pc−Ps almost vanishes. If the pressure difference vanishes, in the valve mechanism having the above-described structure, the valve body moves toward the side of crank chamber pressure (Pc) introducing path by being urged by the spring, and when the discharge pressure introducing path and the side of the crank chamber pressure (Pc) introducing path are communicated with each other through the above-described communication path, discharge gas flows into the crank chamber. On the other hand, the pressure difference of Pc−Ps increases more than ΔP, the valve body moves in an opposite direction against the force of the spring, the communication through the above-described communication path is interrupted, and the flowing-in of the discharge gas is stopped. Such introduction and interruption of discharge gas into the crank chamber are repeated depending upon the pressure difference of Pc−Ps, and discharge gas containing lubricating oil is introduced into the crank chamber discontinuously. The degree of this introduction of discharge gas into the crank chamber is adjusted by the constant pressure difference set so that the valve body is moved, and the constant pressure difference ΔP is adjusted and set by the spring in the above-described structure. Namely, it is possible to adjust the flow rate of discharge gas containing lubricating oil by setting of ΔP, and by this, it also becomes possible to store an adequate amount of lubricating oil in the crank chamber.

The above-described structure of compressor according to the present invention can be applied to any of a variable displacement compressor and a fixed displacement compressor. For example, a structure can be employed wherein the compressor is a piston type variable displacement compressor in which the crank chamber pressure is rendered to be the intermediate pressure and which has a displacement control valve and a plurality of cylinder bores, and wherein the displacement control valve controls a pressure difference between crank chamber pressure and suction pressure in a range capable of increasing displacement from a minimum displacement operation condition at which the displacement control valve is completely closed. In this case, a structure can be employed wherein the displacement control valve comprises an electromagnetic valve, and crank chamber pressure is controlled by an on/off signal sent thereto. Alternatively, a structure can be employed wherein the displacement control valve comprises a valve which can sense an index for displacement control, which can change a target index for displacement control by an external signal, and which is closed until a sensed index for displacement control reaches the target index determined by the external signal. Further, such a structure of compressor according to the present invention is suitable also for a clutchless compressor.

Further, the above-described structure of compressor according to the present invention can also be applied to, for example, a piston type fixed displacement compressor in which crank chamber pressure is intermediate pressure and which has a plurality of cylinder bores.

With respect to supply of lubricating oil, if a structure is employed wherein discharge gas is introduced into the region of intermediate pressure from a lower portion of an oil separator or an oil storage chamber, more adequate supply of lubricating oil becomes possible.

Such a structure of compressor according to the present invention, as aforementioned, is effective particularly for a case where carbon dioxide becoming a high pressure is used as refrigerant. Further, the compressor according to the present invention is suitable for use in an air conditioning system for vehicles.

Effect According To The Invention

Thus, in the compressor according to the present invention, by providing a valve mechanism having a simple structure without using pressure reducing means such as an aperture, it becomes possible to introduce a mixture of discharge gas and refrigerating machine oil stably and adequately into the region of intermediate pressure requiring lubrication, thereby improving the lubricity of rolling part and slide part in the region of intermediate pressure. Further, because the amount of refrigerating machine oil introduced into the region of intermediate pressure can also be optimized, it becomes possible to hold an adequate amount of refrigerating machine oil in the region of intermediate pressure, thereby improving an efficiency of a heat exchanger, etc. and reducing a pressure loss of a refrigeration cycle by reducing an oil circulation rate in the refrigeration cycle.

EXPLANATION OF SYMBOLS

Figure 1:
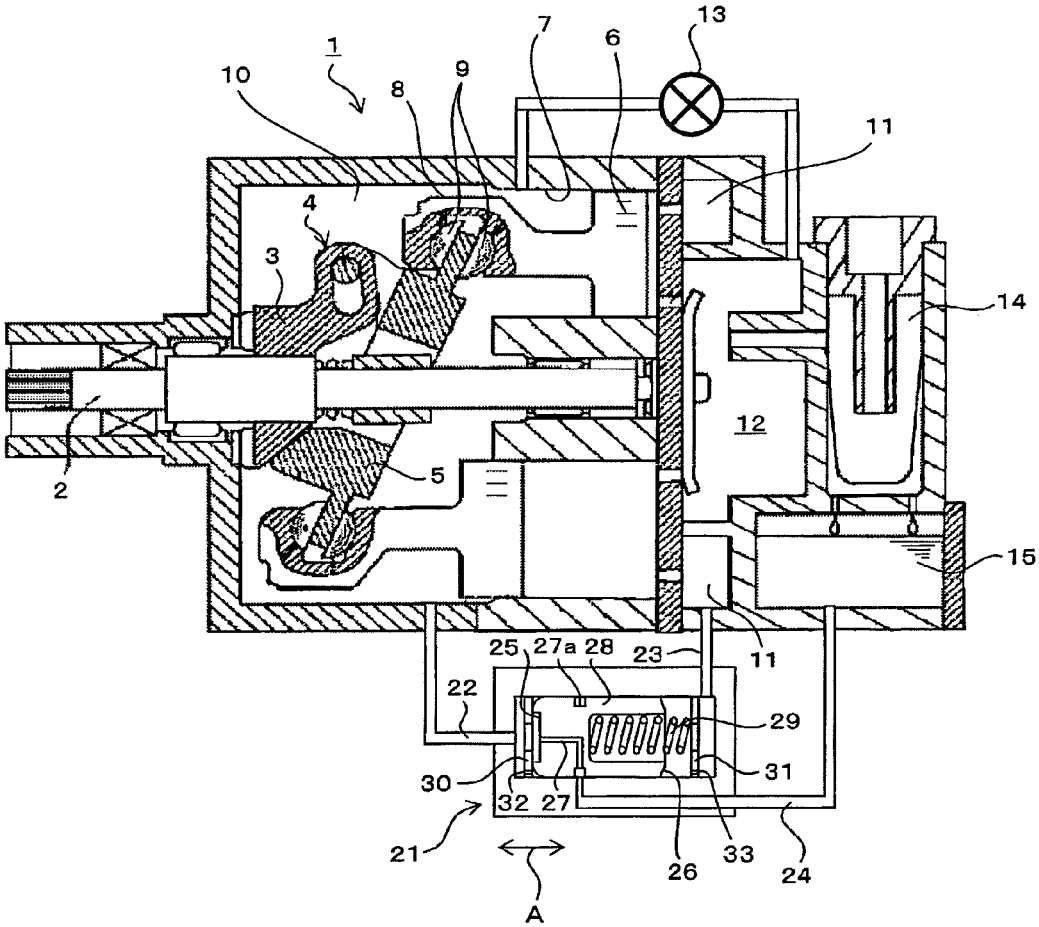
FIG. 1 is a schematic vertical sectional view of a compressor according to an embodiment of the present invention.

1: compressor
2: main shaft
5: swash plate
6: piston
7: cylinder bore
10: crank chamber as region of intermediate pressure
11: suction chamber
12: discharge chamber
13: displacement control valve
14: oil separator
15: oil storage
21: valve mechanism
22: intermediate pressure introducing path (crank chamber pressure introducing path)
23: suction pressure introducing path
24: discharge gas introducing path
25: intermediate pressure sensitive surface
26: suction pressure sensitive surface
27: communication path
27*a*: discharge gas introducing groove
28: valve body
29: spring
30: first stopper
31: second stopper
32: first pressure equalizing hole
33: second pressure equalizing hole

The Best Mode For Carrying Out The Invention

Hereinafter, desirable embodiments of the present invention will be explained referring to figures.

FIG. 1 depicts a compressor according to an embodiment of the present invention, and specifically, shows a case where the present invention is applied to a swash plate type variable displacement compressor. Compressor 1 comprises main shaft 2 (drive shaft) driven at a clutchless condition, rotor 3 rotated integrally with main shaft 2, and swash plate 5 which is connected to rotor 3 via hinge mechanism 4 changeable in inclination angle and rotated together with main shaft 2. Symbol 6 indicates a piston inserted into each cylinder bore 7 capable of being reciprocated, and piston 6 is brought into contact with the outer circumferential portions slidably via a pair of shoes 9 at its bridge portion 8 and through the slidable contact, the rotational movement of swash plate 5 is converted into the reciprocal movement of piston 6. Symbol 10 indicates a crank chamber as a region of intermediate pressure, symbol 11 indicates a suction chamber of refrigerant (for example, carbon dioxide), and symbol 12 indicates a discharge chamber of compressed gas, respectively. In this embodiment, by controlling introduction of discharge gas (discharge pressure) of discharge chamber 12 into crank chamber 10 by displacement control valve 13, the pressure in crank chamber 10 is adjusted, and through this adjustment, the inclination angle of swash plate 5, namely, the displacement for discharge of compressor 1, is controlled. Symbol 14 indicates an oil separator which separates oil (refrigerating machine oil) in the discharge gas introduced from discharge chamber 12 before discharged to outside of the compressor, and the oil separated by oil separator 14 is temporarily stored in oil storage 15 provided at a lower position. The structure described here is a conventional structure.

In the present invention, provided is a valve mechanism 21 which introduces discharge gas into the region of intermediate pressure so that a pressure difference between (a) the intermediate pressure between discharge pressure and suction pressure and (b) the suction pressure becomes constant. In this embodiment, this valve mechanism 21 comprises intermediate pressure introducing path 22 (crank chamber pressure introducing path) communicating with crank chamber 10 as the region of intermediate pressure, suction pressure introducing path 23 communicating with suction chamber 11 as a region of suction pressure, discharge gas introducing path 24 capable of communicating with discharge chamber 12, especially, the portion of oil storage 15 located at a lower position of oil separator 14, and introducing discharge gas containing oil, valve body 28 having intermediate pressure sensitive surface 25 sensing intermediate pressure (crank chamber pressure) introduced from the intermediate pressure introducing path 22 and suction pressure sensitive surface 26 sensing suction pressure introduced from the suction pressure introducing path 23 on respective sides in a movement direction (direction shown by arrow A), having discharge gas introducing groove 27*a* extending over the entire circumference capable of communicating the intermediate pressure introducing path 24 by movement, and having therein communication path 27 capable of communicating the side of the intermediate pressure introducing path 22 and the side of the discharge gas introducing path 24 with each other through the discharge gas introducing groove 27*a*, and spring 29 provided at the side of suction pressure introducing path 23 of valve body 28 and capable of generating a force corresponding to the above-described constant pressure difference relative to the valve body 28. To valve body 28, further, at the side of intermediate pressure introducing path 22, first stopper 31 is provided for, when valve body 28 has been moved to the side of intermediate pressure introducing path 22, stopping valve body 28 at a position (position depicted in FIG. 1) at which discharge gas introducing groove 27*a* just communicates with discharge gas introducing path 24 and through the communication the discharge gas from the discharge gas introducing path 24 can be introduced into the side of intermediate pressure introducing path 22 through communication path 27. Further, also to the side of suction pressure introducing path 23, namely, the side of spring 29, provided is second stopper 31 which becomes a fixed terminal end of spring 29 and which regulates the movement of valve body 28 in this direction (stops the valve body 28 at a predetermined position decided in advance). To first stopper 30 and second stopper 31, provided are first and second pressure equalizing holes 32, 33 which communicate both sides of stoppers 30, 31 with each other even when valve body 28 is stopped by stoppers 30, 31, respectively. The structure providing these first and second pressure equalizing holes 32, 33 can achieve to introduce intermediate pressure or suction pressure so that the pressure receiving area of valve body 28 becomes a target area even in a condition where valve body 28 comes into contact with first stopper 30 on the side of intermediate pressure introducing path 22 or second stopper 31 on the side of suction pressure introducing path 23.

Figure 2:
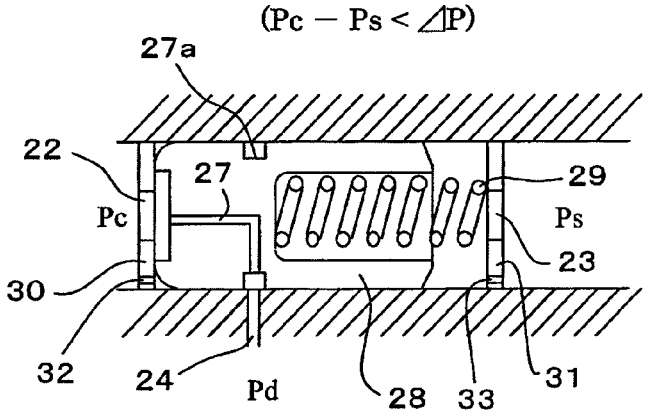
FIG. 2 is a schematic sectional view of a valve mechanism of the compressor depicted in FIG. 1, showing an operation state of the valve mechanism.
Figure 3:
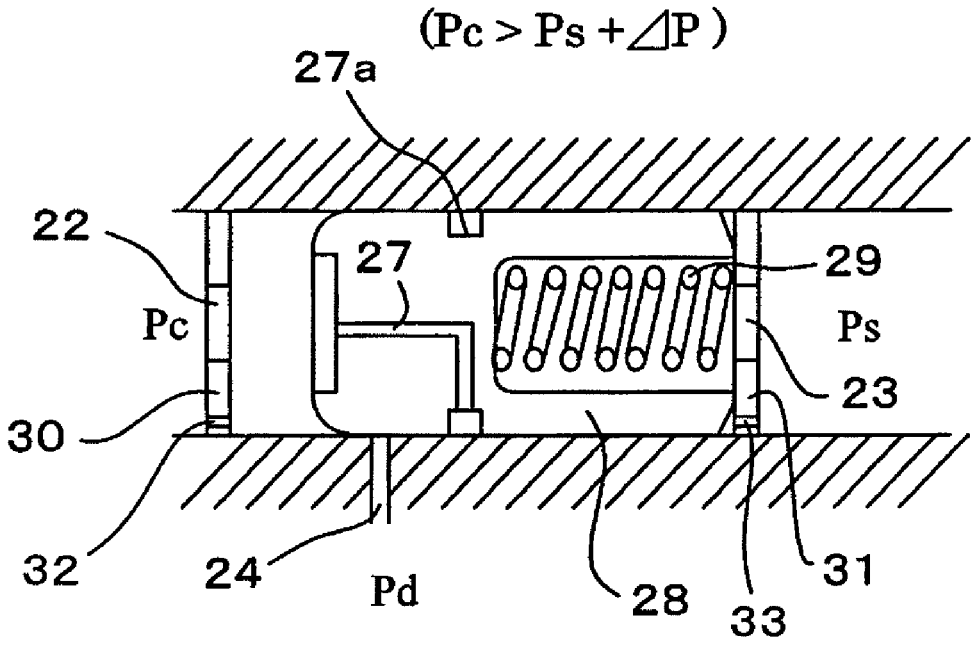
FIG. 3 is a schematic sectional view of a valve mechanism of the compressor depicted in FIG. 1, showing another operation state of the valve mechanism.

This valve mechanism 21 is operated as shown in FIGS. 2 and 3. In FIGS. 2 and 3, Pc indicates a crank chamber pressure as intermediate pressure, Ps indicates a suction pressure, and Pd indicates a pressure in discharge gas introducing path 24 (namely, nearly a discharge chamber pressure), respectively, and ΔP indicates a set value of a pressure difference between crank chamber pressure and suction pressure. If the pressure difference of Pc−Ps almost vanishes (it becomes a condition smaller than ΔP), valve body 28 moves to a position shown in FIG. 2, namely, moves by being pressed by spring 29 and moves up to a position being stopped by contact with first stopper 30, discharge gas introducing groove 27*a* just communicates with discharge gas introducing path 24, and from there, the discharge gas is introduced into crank chamber 10 through communication path 27. Accompanying with this discharge gas introduction, lubricating oil (refrigerating machine oil) in the discharge gas is also introduced into crank chamber 10. At that time, the pressure receiving area of the side of crank chamber pressure Pc of valve body 28 is ensured by Pc pressure introduction due to first pressure equalizing hole 32. On the other hand, if the pressure difference of Pc−Ps becomes not less than ΔP, valve body 28 is moved to a position shown in FIG. 3, namely, moved to a position being contacted with second stopper 31 against the force of spring 29, and the communication between discharge gas introducing groove 27*a* and discharge gas introducing path 24 is stopped and the above-described introduction of discharge gas is stopped. At that time, the pressure receiving area of the side of suction pressure Ps of valve body 28 is ensured by Ps pressure introduction due to second pressure equalizing hole 33. Thus, valve body 28 is moved in accordance with the greater/smaller relationship with the constant pressure difference capable of being set by spring 29, and by repeating communication and interruption thereof through communication path 27, discharge gas containing lubricating oil is introduced discontinuously into crank chamber 10. In the structure of this valve mechanism 21, it is possible to adjust the flow rate of discharge gas containing lubricating oil by setting ΔP, and it also becomes possible to store an adequate amount of lubricating oil in crank chamber 10.

In an air conditioning system for vehicles using variable displacement compressor 1 depicted in FIG. 1 into which valve mechanism carrying out the operation shown in FIGS. 2 and 3 is incorporated, when the air conditioning system is initiated, compressor 1 is driven until the temperature in a vehicle interior becomes near a set temperature. At that time, although displacement control valve 13 adjusting crank chamber pressure is in a complete closed condition, a mixture of discharge gas and oil can be introduced into crank chamber 10 by valve mechanism 21 according to the present invention. In the conventional method wherein an adequate amount of oil is introduced into a crank chamber by pressure reduction due to an aperture, there has been a possibility that the aperture portion is clogged by foreign matters, but in the present invention, because a relatively large path diameter can be employed by the discontinuous introduction, the possibility being clogged by foreign matters can be greatly decreased.

Further, in a case of combining a clutchless compressor and a normal open type electromagnetic valve as the displacement control valve, in order to obtain a good control performance at the time of a usual compression operation, it is better to set the flow rate at the time of complete closed condition lower and to enlarge the range of practical duty ratio, thereby achieving a fine control. In order to maintain the inclination angle of the swash plate at an inclination angle corresponding to a minimum displacement at the time of operation OFF, it is necessary to set the flow rate at the time of complete closed condition greater and to efficiently introduce discharge gas into the crank chamber to maintain the pressure difference of Pc−Ps greater. Thus, the contrary flow performances of electromagnetic valve are required. However, by employing the valve mechanism according to the present invention, because the pressure difference of Pc−Ps at the time of operation OFF can be maintained great by paying attention to the control performance even if the flow rate at the time of complete closed condition is set low, it becomes possible to maintain the inclination angle of swash plate at an inclination angle corresponding to minimum displacement. Therefore, the present invention is effective also from the viewpoint of displacement control of compressor.

Where, although the above-described explanation has been carried out mainly with respect to a variable displacement compressor, the present invention can be applied to a fixed displacement compressor as aforementioned.

Industrial Applications Of The Invention

The structure of the compressor according to the present invention can be applied to any of a variable displacement compressor and a fixed displacement compressor, it is suitably used particularly for a case using carbon dioxide refrigerant which becomes a high-pressure specification, and especially, it is suitable for use in an air conditioning system for vehicles.

The invention claimed is:

1. A compressor having a region of pressure intermediate between discharge pressure and suction pressure characterized in that a valve mechanism is provided for introducing discharge gas into said region of intermediate pressure so as to render constant a pressure difference between intermediate pressure and suction pressure;

wherein said valve mechanism comprises an intermediate pressure introducing path communicating with said region of intermediate pressure, a suction pressure introducing path communicating with a region of suction pressure, a discharge gas introducing path capable of introducing discharge gas, a valve body having an intermediate pressure sensitive surface sensing intermediate pressure introduced from said intermediate pressure introducing path and a suction pressure sensitive surface sensing suction pressure introduced from said suction pressure introducing path on respective sides in a movement direction and having therein a communication path capable of communicating said intermediate pressure introducing path and said discharge gas introducing path with each other by movement, and a spring capable of giving a force corresponding to said constant pressure difference to said valve body.

2. The compressor according to claim 1, wherein a first stopper is provided to an intermediate pressure introducing path side of said valve body for stopping said valve body having been moved at a position at which said intermediate pressure introducing path and said discharge gas introducing path communicate with each other through said communication path.

3. The compressor according to claim 2, wherein a first pressure equalizing hole is provided to said first stopper for communicating both sides of said stopper at a state where said valve body has been stopped by said stopper at said position at which said intermediate pressure introducing path and said discharge gas introducing path communicate with each other and for introducing intermediate pressure onto said intermediate pressure sensitive surface.

4. The compressor according to claim 1, wherein a second stopper is provided to a suction pressure introducing path side of said valve body for stopping said valve body having been moved at a predetermined position.

5. The compressor according to claim 4, wherein a second pressure equalizing hole is provided to said second stopper for communicating both sides of said stopper at a state where said valve body has been stopped by said stopper at said predetermined position and for introducing suction pressure onto said suction pressure sensitive surface.

6. The compressor according to claim 1, wherein said compressor is a piston type variable displacement compressor in which crank chamber pressure is intermediate pressure and which has a displacement control valve and a plurality of cylinder bores, and said displacement control valve controls a pressure difference between crank chamber pressure and suction pressure in a range capable of increasing displacement from a minimum displacement operation condition at which said displacement control valve is completely closed.

7. The compressor according to claim 6, wherein said displacement control valve comprises an electromagnetic valve, and crank chamber pressure is controlled by an on/off signal sent thereto.

8. The compressor according to claim 6, wherein said displacement control valve comprises a valve which can sense an index for displacement control, which can change a target index for displacement control by an external signal, and which is closed until a sensed index for displacement control reaches said target index determined by said external signal.

9. The compressor according to claim 6, wherein said compressor is a clutchless compressor.

10. The compressor according to claim 1, wherein said compressor is a piston type fixed displacement compressor in which crank chamber pressure is intermediate pressure and which has a plurality of cylinder bores.

11. The compressor according to claim 1, wherein discharge gas is introduced into said region of intermediate pressure from a lower portion of an oil separator or an oil storage chamber.

12. The compressor according to claim 1, wherein said compressor compresses carbon dioxide refrigerant.

13. The compressor according to claim 1, wherein said compressor is used in an air conditioning system for vehicles.

* * * * *